US008267544B2

(12) United States Patent
Zheng et al.

(10) Patent No.: US 8,267,544 B2
(45) Date of Patent: Sep. 18, 2012

(54) LED LAMP

(75) Inventors: Shi-Song Zheng, Shenzhen (CN); Chin-Chung Chen, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 171 days.

(21) Appl. No.: 12/967,080

(22) Filed: Dec. 14, 2010

(65) Prior Publication Data

US 2012/0106152 A1 May 3, 2012

(51) Int. Cl.
*F21V 33/00* (2006.01)

(52) U.S. Cl. ..... 362/249.02; 362/362; 362/431

(58) Field of Classification Search ..... 362/362, 362/368, 374, 375, 249.02, 431, 800
See application file for complete search history.

(56) References Cited

U.S. PATENT DOCUMENTS 7,832,898 B2 * 11/2010 Li ..... 362/249.02
2010/0296287 A1 * 11/2010 Huang ..... 362/249.02
2010/0309662 A1 * 12/2010 Zheng ..... 362/235
2010/0309664 A1 * 12/2010 Liu et al. ..... 362/235

* cited by examiner

*Primary Examiner* — Laura Tso
(74) *Attorney, Agent, or Firm* — Altis Law Group, Inc.

(57) ABSTRACT

An LED (light emitting diode) lamp includes a lamp body, a cap mounted on an end of the lamp body, a lamp holder mounted on an opposite end of the lamp body, and a plurality of fasteners. The lamp body includes two beams located at two opposite lateral sides thereof and a plurality of separated light emitting modules mounted on the beams side by side. Each of the fasteners extends through the lamp body, the light emitting modules and the cap in series to secure the lamp body, the light emitting modules, and the cap together.

15 Claims, 8 Drawing Sheets

LED LAMP

BACKGROUND

1. Technical Field

The disclosure generally relates to a lamp and, more particularly, to an LED lamp.

2. Description of Related Art

An LED lamp utilizing LEDs as a source of illumination is widely used in many fields because the LEDs have features of long-term reliability, environment friendliness and low power consumption. It is well-known that a conventional lamp utilizes fluorescent lights as a source of illumination. With the development of the LED lamp, the LED lamp is intended to be a cost-effective yet high quality replacement for the conventional fluorescent lamp.

Generally, the LED lamp comprises a bracket integrally formed via a metal die casting or a metal extrusion by a die/mould and a plurality of LED modules received in the bracket. The LED lamp can achieve a fixed illumination intensity because a dimension of the bracket is fixed. For achieving different illumination intensities according to different needs, the dimension of the bracket has to be changed. However, a change of the die/mould for forming the bracket raises a considerable cost burden. Furthermore, to have different dies/moulds with different sizes requires a high manufacture, inventory and material cost.

What is needed, therefore, is an LED lamp whose light intensity can be easily adjusted by increasing or decreasing the number of LEDs thereof for meeting different illumination demands.

BRIEF DESCRIPTION OF THE DRAWINGS

Many aspects of the present embodiments can be better understood with reference to the following drawings. The components in the drawings are not necessarily drawn to scale, the emphasis instead placed upon clearly illustrating the principles of the present embodiments. Moreover, in the drawings, like reference numerals designate corresponding parts throughout the various views.

DETAILED DESCRIPTION

Figure 1:
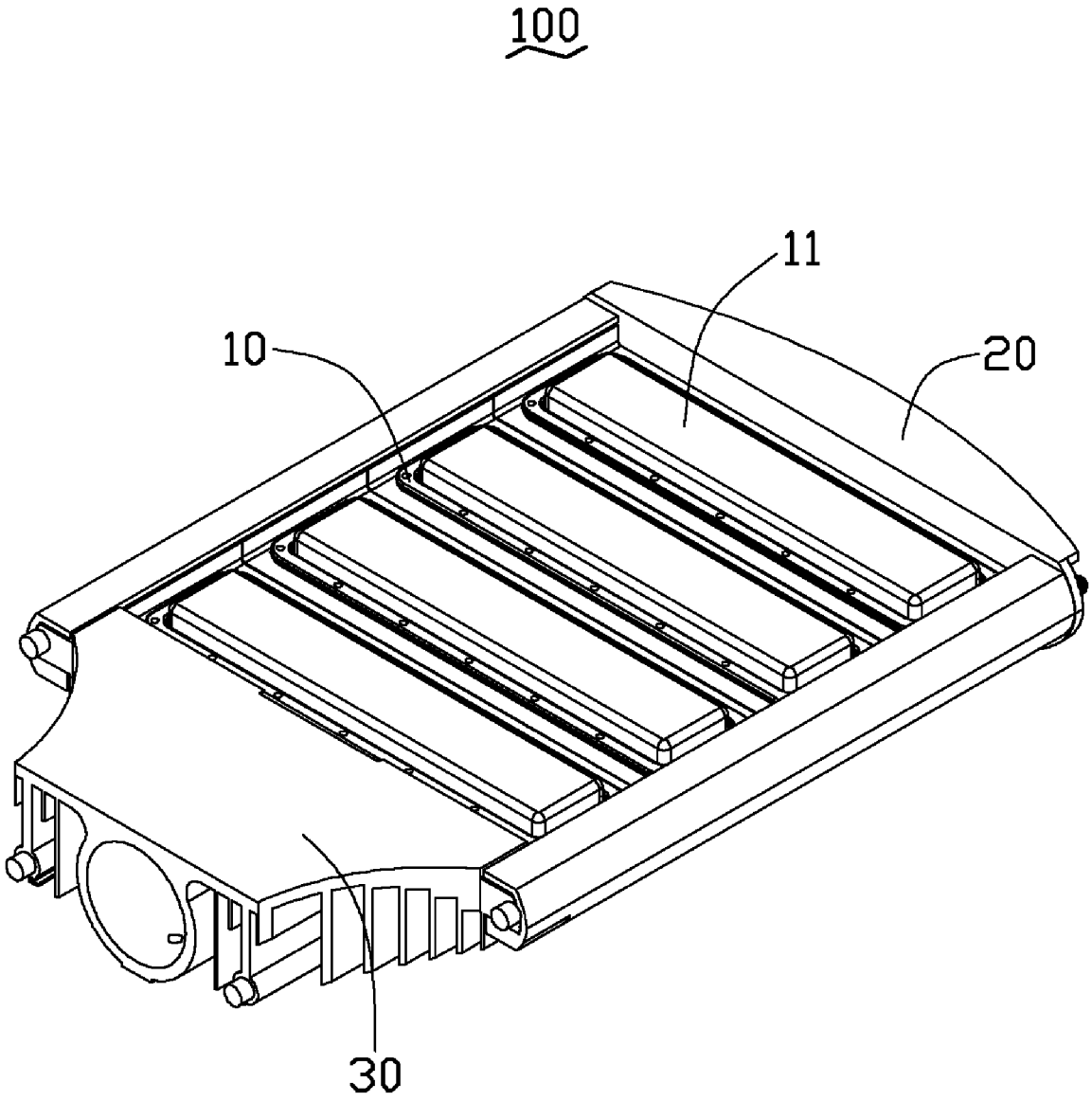
FIG. 1 is an isometric, assembled view of an LED lamp in accordance with a first embodiment of the disclosure.
Figure 2:
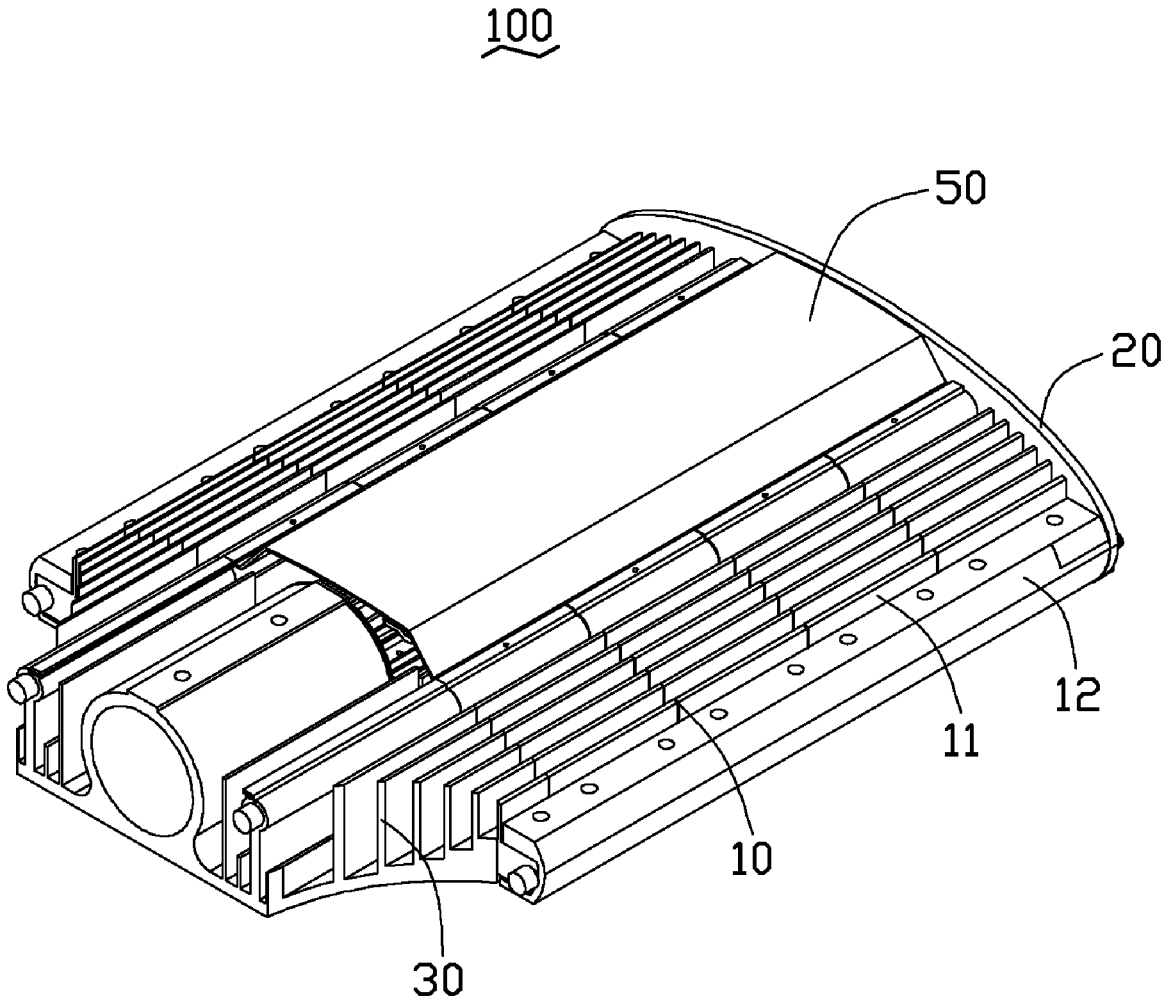
FIG. 2 is an inverted view of the LED lamp of FIG. 1.
Figure 3:
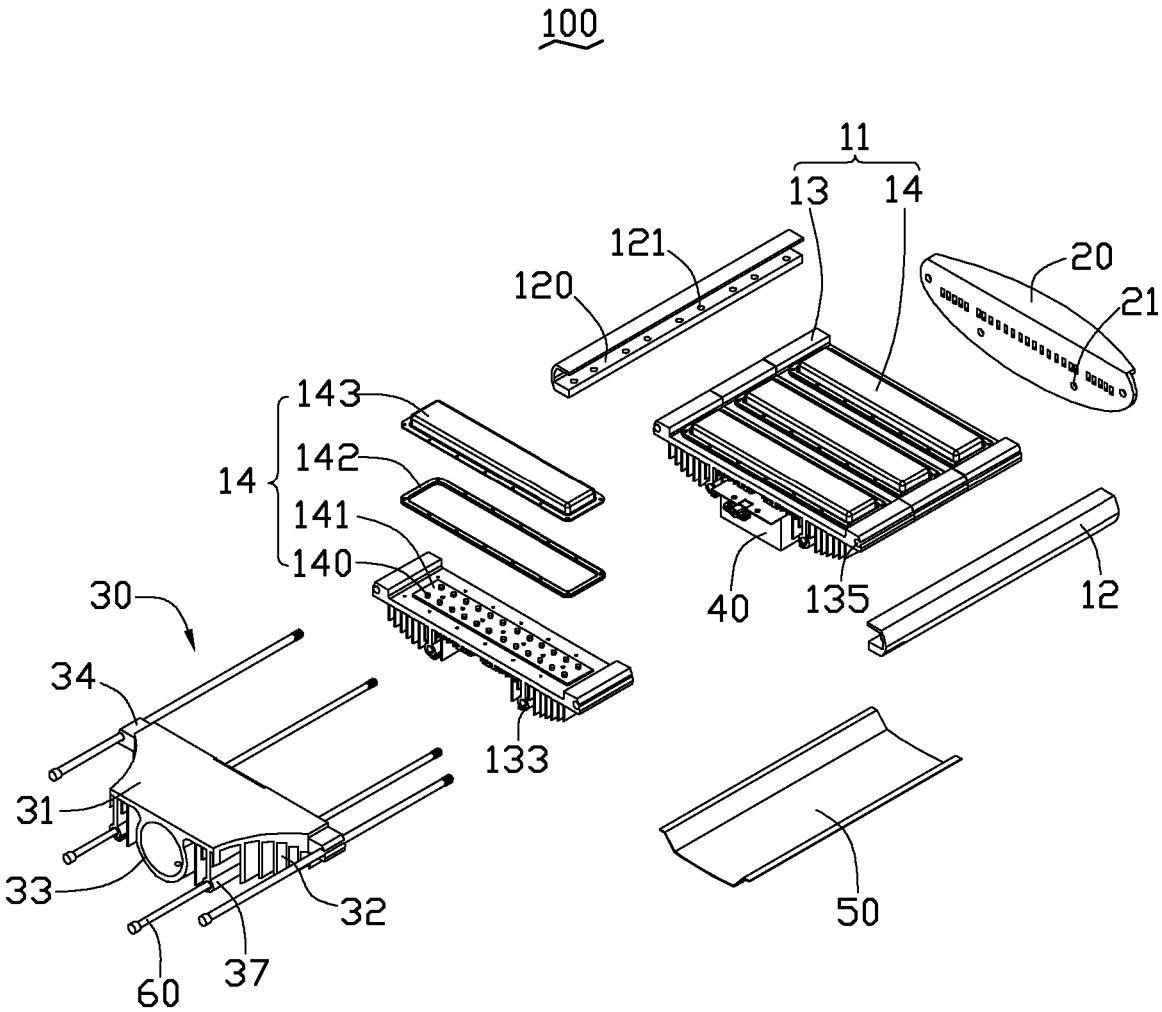
FIG. 3 is an exploded view of the LED lamp of FIG. 1.

Referring to FIGS. 1-3, an LED lamp 100 in accordance with a first embodiment of the disclosure is illustrated. The LED lamp 100 can be used as a street lamp. The LED lamp 100 comprises a lamp body 10, a cap 20 and a lamp holder 30 respectively mounted on two opposite ends of the lamp body 10, a driving circuit unit 40 mounted on a bottom portion of the lamp body 10, and a cover 50 covering the driving circuit unit 40.

The lamp body 10 comprises two beams 12 and a plurality of light emitting modules 11. The light emitting modules 11 are separated from each other. Each of the light emitting modules 11 has two opposite ends thereof respectively sliding into the beams 12 and mounted to the beams 12. The light emitting modules 11 are arranged side by side.

Each of the light emitting modules 11 comprises a heat sink 13 and an LED module 14 mounted on the heat sink 13. The heat sink 13 is integrally formed of a metal with good heat conductivity such as aluminum, copper or an alloy thereof. In this embodiment, the heat sink 13 is formed via cutting an elongated extruded semi-finished product into different widths; thus, the heat sink 13 can be manufactured into different widths by severing an extruded semi-finished product, without the necessity of redesigning a mould/die.

Figure 4:
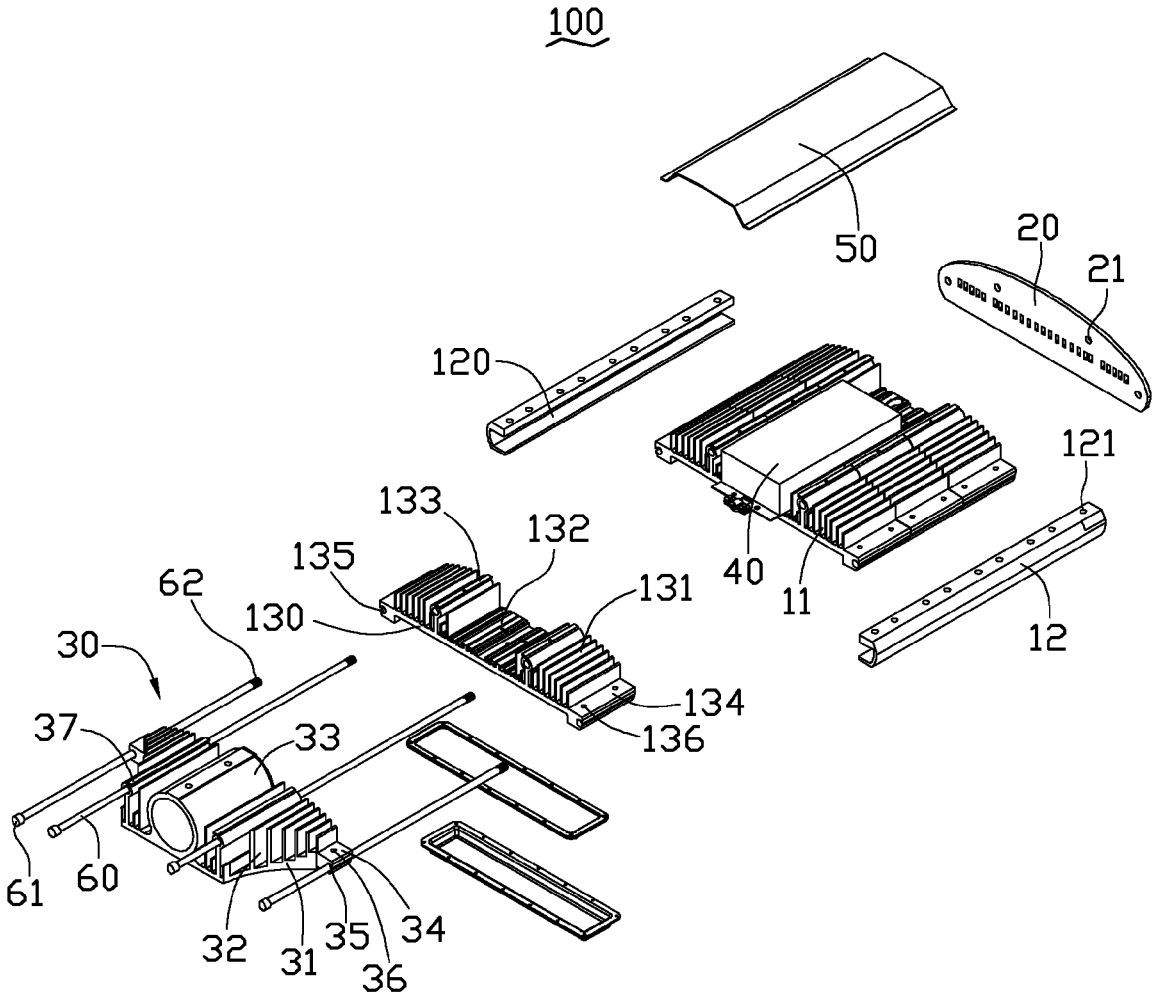
FIG. 4 is an inverted view of the LED lamp of FIG. 3.

Referring also to FIG. 4, the heat sink 13 has an elongated configuration. The heat sink 13 comprises a base 130 and a fin unit (not labeled) including a plurality of fins 131. The fins 131 extend downwards from a bottom face of the base 130 and along a width direction of the heat sink 13. The fins 131 are parallel to each other and space from each other along a length direction of the base 130. A receiving space 132 is defined in a central portion of the fin unit. Two latching portions 133 are located at two opposite lateral sides of the receiving space 132, and extend along the width direction of the base 130. Two protrusions 134 extend outwards from two opposite ends of the base 130, respectively. Each of the protrusions 134 defines an extending hole 135 extending along the width direction of the base 130. The extending hole 135 communicates with an environment via a cutout (not labeled) defined in an outer side surface of the protrusion 134. Each of the protrusions 134 defines two threaded holes 136 therein extending along a vertical direction.

When the light emitting modules 11 are arranged side by side, the latching portions 133 of one of the light emitting modules 11 are in alignment with the latching portions 133 of an adjacent one of the light emitting modules 11, and the extending holes 135 of two adjacent light emitting modules 11 are in alignment with each other, for facilitating extensions of fasteners 60 therethrough. The receiving spaces 132 of the light emitting modules 11 cooperatively form a receiving groove (not labeled) for receiving the driving circuit unit 40 therein.

The LED module 14 comprises an elongated driving circuit board 141, a plurality of LEDs 140 attached to the driving circuit board 141, a transparent envelope 143, and a sealing ring 142. The driving circuit board 141 is attached to a top surface of the heat sink 13. The transparent envelope 143 covers the driving circuit board 141 and is mounted to the top surface of the heat sink 13. The sealing ring 142 is sandwiched between the transparent envelope 143 and the top surface of the heat sink 13 to seal the driving circuit board 141.

Each of the beams 12 has an elongated configuration. Each beam 12 has a U-shaped cross section. The beams 12 are formed by extrusion. Each beam 12 defines a slot 120 along a lengthways direction thereof. The slot 120 opens towards the light emitting modules 11. Each beam 12 defines a plurality of threaded holes 121 therein along a vertical direction. The threaded holes 121 are located at a lateral side of the slot 120. The protrusions 134 of the light emitting modules 11 slide into the slots 120 of the beams 12, and the threaded holes 136 of the protrusions 134 are aligned with the threaded holes 121 of the beams 12. A number of screws (not shown) extend through the threaded holes 121 and are engaged into the threaded holes 136 of the protrusions 134, thereby securing the light emitting modules 11 with the beams 12.

The cap 20 is attached to one of the light emitting modules 11 located at an end of the lamp body 10. The cap 20 defines four through holes 21 therein. Two of the through holes 21 correspond to the extending holes 135 of the protrusions 134 of the light emitting modules 11, and the other through holes 121 correspond to the latching portions 133 of the light emitting modules 11. Each beam 12 has an end thereof attached to the cap 20. Each beam 12 has an opposite end thereof extending beyond one of the light emitting modules 11 located at an opposite end of the lamp body 10 for connecting with the lamp holder 30 to thereby mount the lamp holder 30 on the opposite end of the beam 12.

The lamp holder 30 comprises a substrate 31 and a plurality of fins 32 extending perpendicularly and downwardly from two opposite ends of the substrate 31. Two corners of the substrate 31 distant from the lamp body 10 are recessed so that each corner has a curved edge. The fins 32 are parallel to each other and parallel to the fins 131 of the light emitting modules 11. A central portion of the substrate 31 does not have any fin thereon. A socket 33 is disposed in the central portion of the substrate 31, for connecting with a lamp pole (not shown). In this embodiment, the socket 33 is a sleeve for engagingly receiving an end of the lamp pole therein. Two bulges 34 extend outwards from two opposite ends of the substrate 31. Each of the bulges 34 defines an extending hole 35 and a mounting hole 36. The extending holes 35 of the bulges 34 are in alignment with the extending holes 135 of the light emitting modules 11. Two latching parts 37 are formed at two opposite lateral sides of the socket 33, respectively. The bulges 34 of the socket 30 slide into the slots 120 of the beams 12, and the mounting holes 36 correspond to the threaded holes 121 of the beams 12. Screws extend through the threaded holes 121 and engage in the mounting holes 36, thereby securing the beams 12 and the lamp holder 30 together.

The number of the fasteners 60 is four in this embodiment. Each of the fasteners 60 is an elongated shaft. Each of the fasteners 60 comprises a head 61 at an end thereof and threads 62 at an opposite end thereof. Two of the fasteners 60 extend through the extending holes 35 of the lamp holder 30, the extending holes 135 of the light emitting modules 11, and the through holes 21 of the cap 20 in series. Nuts (not shown) are engaged with the threads 62 of the fasteners 60. At the same time, the heads 61 of the fasteners 60 resist the bulges 34 of the lamp holder 30. The other two of the fasteners 60 extend through the latching parts 37 of the lamp holder 30, the latching portions 133 of the light emitting modules 11, and the through holes 21 of the cap 20 in series. Nuts are also engaged with the threads 62 of the other two fasteners 60. By doing so, the fasteners 60 secure the lamp holder 30, the cap 20 and the light emitting modules 11 together.

The light emitting modules 11 are separated from each other, and arranged side by side to form the lamp body 10 of the LED lamp 100. In need of increasing or decreasing the number of the light emitting modules 11 of the lamp body 10, it needs to increase or decrease the lengths of the beams 12 and change the number of the light emitting modules 11 in accordance with the length of the beams 12, without the necessity of redesigning a mould/die.

Figure 5:
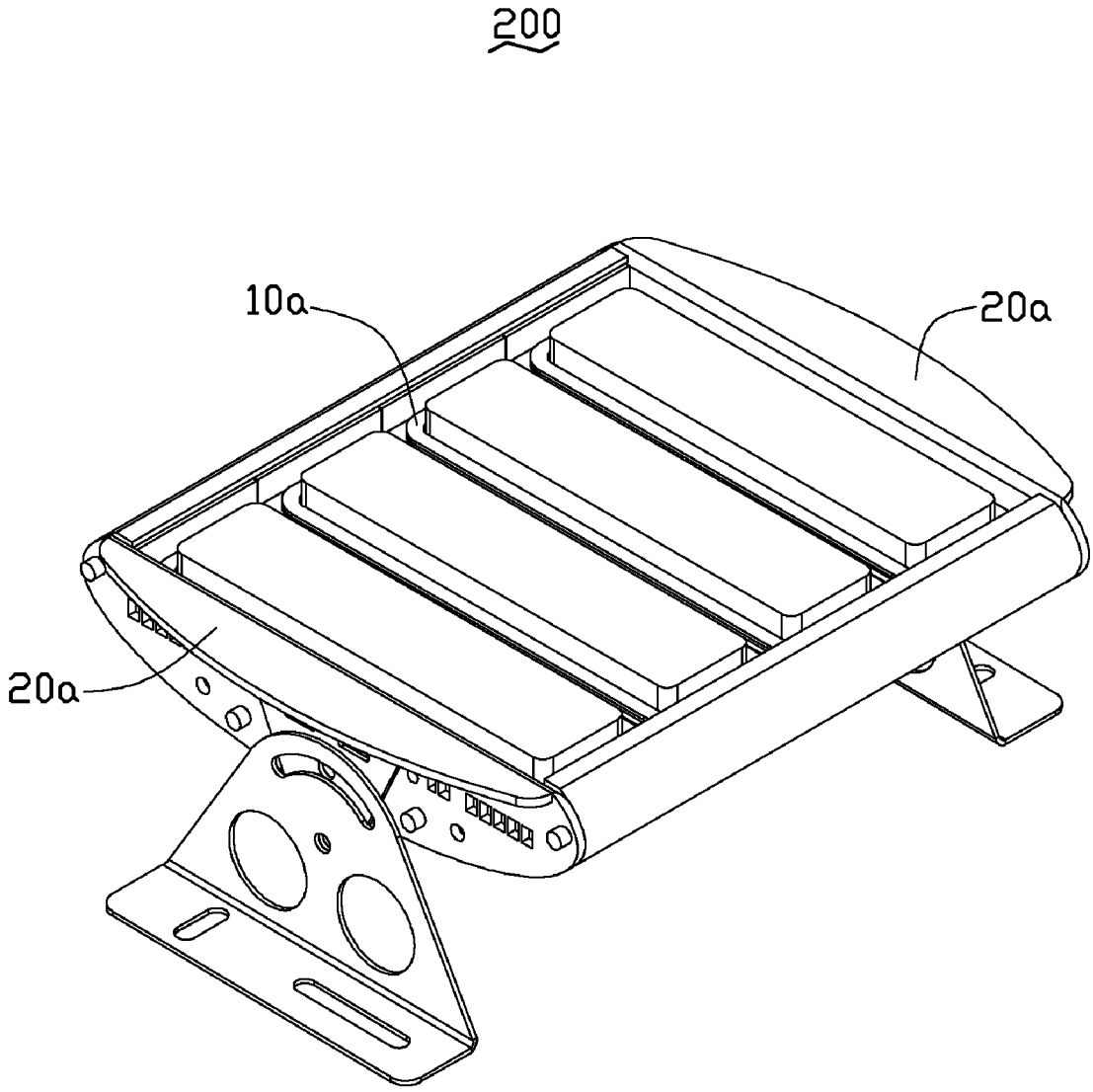
FIG. 5 is an isometric, assembled view of an LED lamp in accordance with a second embodiment of the disclosure.
Figure 6:
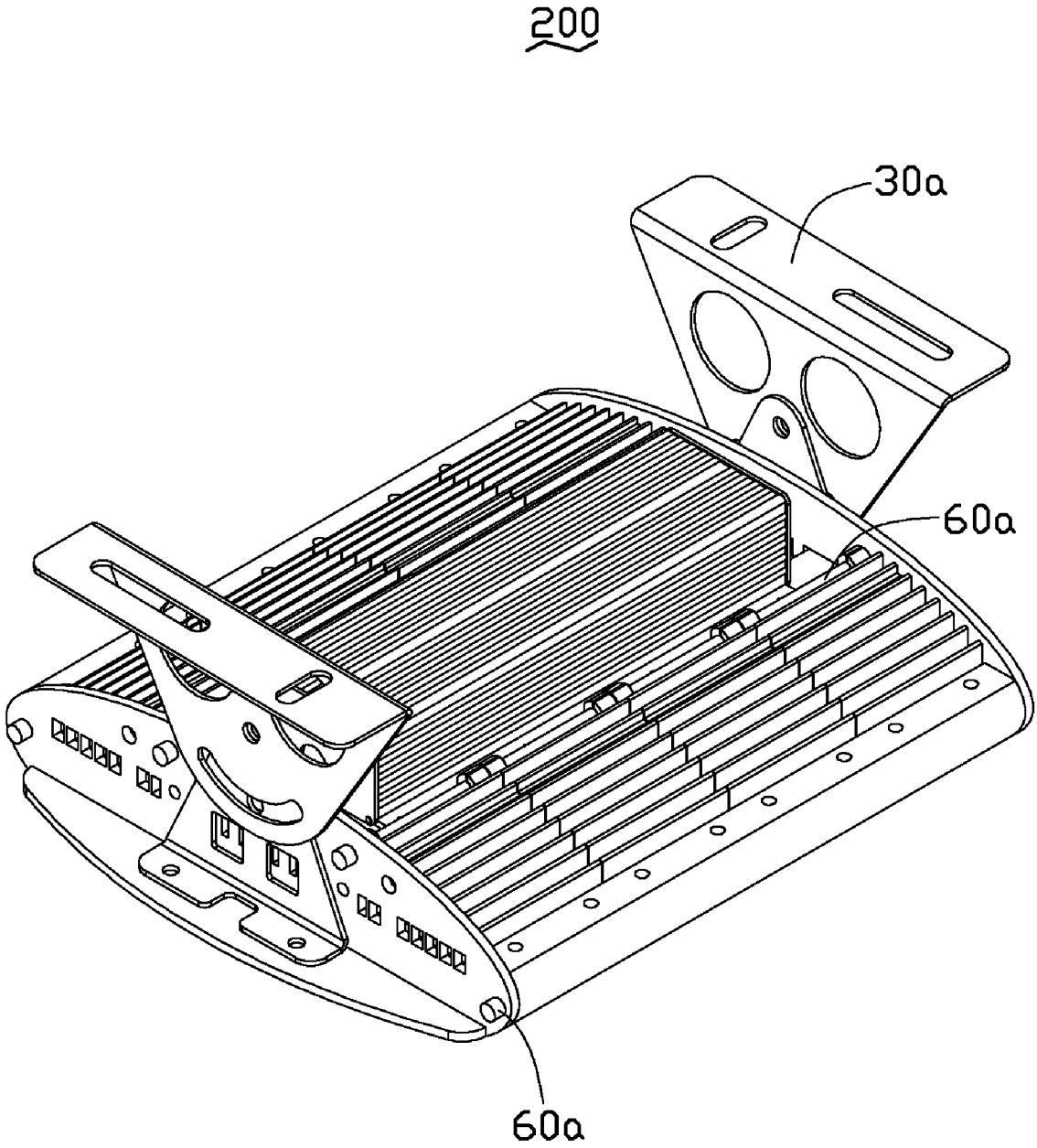
FIG. 6 is an inverted view of the LED lamp of FIG. 5.

Referring to FIGS. 5-6, the LED lamp 200 in accordance with a second embodiment is illustrated. The LED lamp 200 can be used as a projection lamp. The LED lamp 200 is similar to the LED lamp 100 of the first embodiment. The main difference between the LED lamp 100 and the LED lamp 200 is that two caps 20*a* are mounted at two opposite ends of the lamp body 10*a*, respectively, and two brackets 30*a* are mounted on the caps 20*a*, respectively. The LED lamp 200 is secured at a predetermined position via the brackets 30*a*. The fasteners 60*a* secure the caps 20*a* with the lamp body 10*a* in a way similar to that disclosed for the LED lamp 100.

Figure 7:
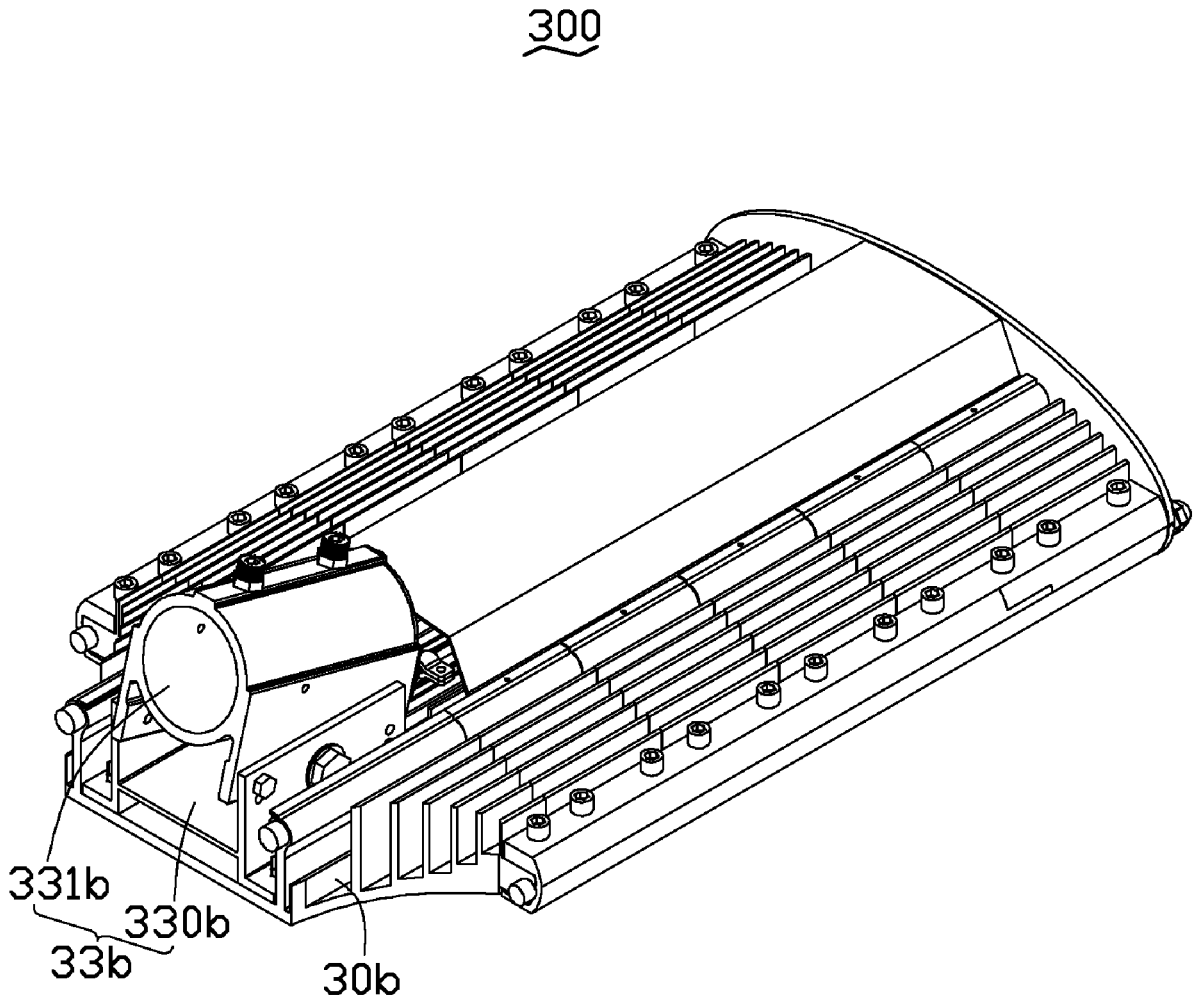
FIG. 7 is an isometric, assembled view of an LED lamp in accordance with a third embodiment of the disclosure.
Figure 8:
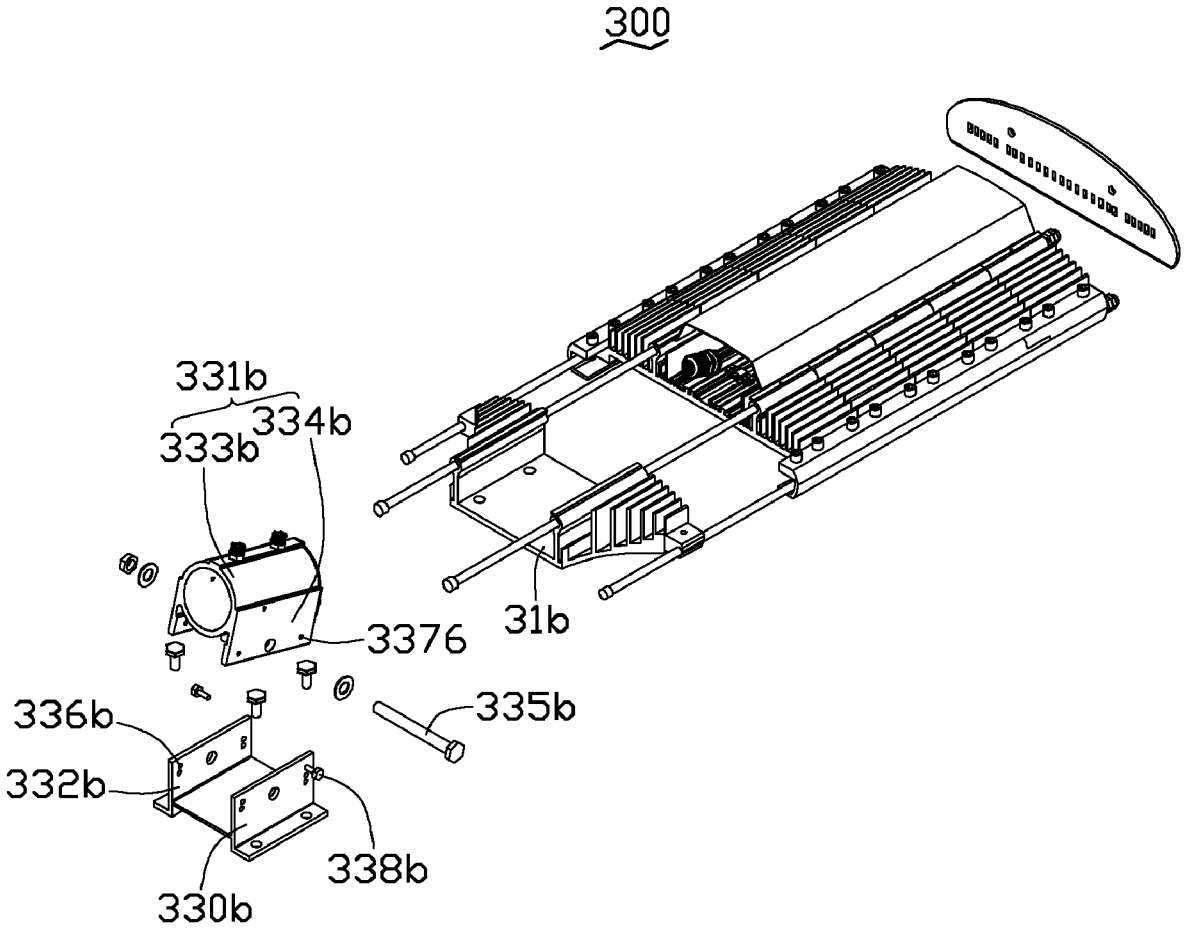
FIG. 8 is an exploded view of the LED lamp of FIG. 7.

Referring to FIGS. 7-8, the LED lamp 300 in accordance with a third embodiment is illustrated. The LED lamp 300 can be used as a street lamp. The LED lamp 300 is similar to the LED lamp 100 of the first embodiment. The main difference between the LED lamp 300 and the LED lamp 100 is that the socket 33*b* (viewed in FIG. 7) replaces the socket 33 of the lamp holder 30 of the LED lamp 100.

The socket 33*b* of the LED lamp 300 comprises a supporting member 330*b* mounted on a substrate 31*b* of the lamp holder 30*b* and a connecting member 331*b* mounted on the supporting member 330*b*. The supporting member 330*b* comprises two spaced sidewalls 332*b*. The connecting member 331*b* comprises a cylinder 333*b* and two mounting plates 334*b* extending from two opposite lateral sides of the cylinder 333*b*. The mounting plates 334*b* are located between the sidewalls 332*b*. A pivot 335*b* extends through central portions of the mounting plates 334*b* and central portions of the sidewalls 332*b*, thereby pivotally connecting the connecting member 331*b* with the supporting member 330*b*. The connecting member 331*b* is rotatable relative to the supporting member 330*b*.

Each of the sidewalls 332*b* defines two spaced adjusting holes 336*b* in each of two opposite ends thereof. Each mounting plate 334*b* defines two inserting holes 337*b* in two opposite ends thereof, respectively. The connecting member 331*b* is pivotable in respect to the supporting member 330*b* in such manner that each of the inserting holes 337*b* is movable to be aligned with one of the adjusting holes 336*b* located at the same end with the inserting hole 337*b*, whereby screws 338*b* can extend through the adjusting holes 336*b* and the inserting holes 337*b*, thereby securing the connecting member 331*b* with the supporting member 330*b* at the desired position, wherein an acute angle is formed between the connecting member 331*b* and the supporting member 330*b*. Due to two adjusting holes 336*b* defined in each of the two opposite ends of each sidewall 332*b*, the acute angle between the connecting member 331*b* and the supporting member 330*b* can be changed by changing the position of the alignment between the adjusting holes 336*b* and the inserting holes 337*b*. When the LED lamp 300 is mounted on a lamp pole, an angle between the LED lamp 300 and a road can be changed. In this embodiment, the maximum angle between the LED lamp 300 and the road reaches to 15 degrees.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED (light emitting diode) lamp comprising:

a lamp body comprising two beams located at two opposite lateral sides thereof and a plurality of separated light emitting modules mounted on the beams side by side;

a cap mounted on an end of the lamp body;

a lamp holder mounted on an opposite end of the lamp body; and a plurality of fasteners, each of the fasteners extending through the lamp body, the light emitting modules and the cap in series to secure the lamp body, the light emitting modules, and the cap together.

2. The LED lamp of claim 1, wherein each of the fasteners is an elongated shaft.

3. The LED lamp of claim 1, wherein each of the light emitting modules has two opposite ends thereof respectively slid into the beams and then mounted on the beams.

4. The LED lamp of claim 3, wherein each of the light emitting modules comprises a heat sink and an LED module mounted on the heat sink, the heat sink forming two protrusions at two opposite ends thereof, each of the beams defining a slot along a lengthways direction thereof, the protrusions sliding into the slots of the beams and being mounted on the beams.

5. The LED lamp of claim 4, wherein the heat sink is formed by extrusion, and each beam is formed by extrusion.

6. The LED lamp of claim 4, wherein two bulges are formed at two opposite ends of the lamp holder, each of the bulges defining an extending hole, each of the protrusions defining an extending hole along a width direction of the heat sink, a part of the fasteners extending through the extending holes of the lamp holder and the extending holes of the heat sink and then being secured with the cap.

7. The LED lamp of claim 6, wherein the heat sink disposes two latching portions close to a central portion of the heat sink, the lamp holder forming two latching parts in alignment with the latching portions of the heat sink, respectively, the other part of the fasteners extending through the latching parts and the latching portions and then being secured with the cap.

8. The LED lamp of claim 7, wherein a receiving space is defined in the central portion of the heat sink, the latching portions being located at two opposite lateral sides of the receiving space.

9. The LED lamp of claim 7, wherein a socket is located between the latching parts of the lamp holder, for connecting with a lamp pole.

10. The LED lamp of claim 9, wherein the socket is a sleeve coiling around the lamp pole.

11. The LED lamp of claim 9, wherein the socket comprises a supporting member and a connecting member pivotally connected with the supporting member, the connecting member coiling around the lamp pole.

12. The LED lamp of claim 11, wherein the connecting member comprises a cylinder and two mounting plates extending from two opposite lateral sides of the cylinder, the supporting member comprising two spaced sidewalls, a pivot extending through central portions of the mounting plates and central portions of the sidewalls, thereby pivotally connecting the connecting member with the supporting member.

13. The LED lamp of claim 12 further comprising a plurality of screws, wherein each of the sidewalls of the supporting member defines two spaced adjusting holes in each of two opposite ends thereof, each of the mounting plates of the connecting member defining two inserting holes in two opposite ends thereof, each inserting hole optionally corresponding to one of the adjusting holes located at the same end with the inserting hole, the screws extending through the inserting holes and corresponding adjusting holes to secure the supporting member with the connecting member.

14. The LED lamp of claim 1, wherein the lamp holder is an additional cap being the same as the cap.

15. The LED lamp of claim 14, wherein two brackets are mounted on the cap and the additional cap, respectively, for mounting the lamp body at a predetermined position.

* * * * *